United States Patent [19]

Wilbanks et al.

[11] 3,938,459

[45] Feb. 17, 1976

[54] MINESWEEPER

[75] Inventors: Edward A. Wilbanks; Vordaman H. Van Bibber, both of Panama City, Fla.

[73] Assignee: The United States of America as represented by the Secretary of the Navy, Washington, D.C.

[22] Filed: June 26, 1972

[21] Appl. No.: 268,224

[52] U.S. Cl. ..... 114/77 R

[51] Int. Cl.[2] ..... B63B 3/02

[58] Field of Search ..... 114/.5 F, 20 R, 68, 69, 114/77, 221 R, 235, 240 R; 9/25; 102/16, 18; 85/1 JP; 292/327

[56] References Cited

UNITED STATES PATENTS

| | | | |
|---|---|---|---|
| 1,458,134 | 6/1923 | Constan | 114/77 R X |
| 2,666,933 | 1/1954 | Engensperger | 9/25 |
| 2,832,041 | 4/1958 | Trachtenberg | 114/240 R X |
| 3,036,539 | 5/1962 | Storey | 114/.5 F |
| 3,340,843 | 9/1967 | Jones | 114/68 |

*Primary Examiner*—Samuel Feinberg

*Attorney, Agent, or Firm*—Richard S. Sciascia; Don D. Doty

[57] ABSTRACT

A simulated marine vehicle is disclosed as being a sweeper of acoustic, pressure, and magnetic energy responsive mines. It includes an exceedingly light-weight, substantially unsinkable hull composed of a plurality of air foam plastic compartments tandemly connected by means of unique fasteners, with a resilient fluid tight sealant therebetween. A suitable ballast material is disposed in the compartments of said hull, an insulated electromagnetic energy generating wire is mounted around said hull, and a motor-generator is mounted on said hull for timely effecting the electrical excitation of said wire.

10 Claims, 10 Drawing Figures

MINESWEEPER

STATEMENT OF GOVERNMENT INTEREST

The invention described herein may be manufactured and used by or for the Government of the United States of America for governmental purposes without the payment of any royalties thereon or therefor.

FIELD OF THE INVENTION

The present invention relates generally to marine minesweepers and in particular is variable water displacement hull-like segmented structure, which when moved along a course within the range of pressure influence mines, effects a pressure signature that simulates that of a ship to the extent that it causes said pressure influence mines to be detonated, thereby causing said mine to effectively be swept. The sweeping thereof, of course, provides for safe passage for the real ships being simulated thereby. In even greater particularity, the subject invention constitutes a new and unique combination of watertight variable ballast hull segments and magnetic minesweeping apparatus which may be employed simultaneously to effectively clear both pressure and magnetically responsive mines from rivers, bays, estuaries, lakes, seas, oceans, or any other marine environments.

DESCRIPTION OF THE PRIOR ART

Heretofore, air cushion vehicles, wooden ships towing sweep gear, marine vehicles employing underwater pontoons, towed water inflated bags, and the like have been employed in an attempt to simulate actual ship water pressure signatures sufficiently to effect detonation of pressure responsive marine mines. Also, numerous simulated ship hulls having various and sundry flotation apparatus connected thereto and perhaps filled or partially filled with ballast water have been so employed, too. The usual operational procedure used with respect to the aforesaid prior art devices is to tow, push, or drive them along a predetermined channel where it is desired that marine mines be neutralized, so that they will be mistaken for real ships and thereby cause said marine mines to explode in response thereto. For some purposes, the aforesaid prior art devices are quite satisfactory; however, in most instances they leave a great deal to be desired. For example, the hull size is usually limited and, thus, the scope of minesweeping operations is severely limited. Moreover, such hulls and such minesweeping gear could be sunk and, thus, block ship channels intended to be swept or become caught or fouled on other underwater objects, respectively. All are exceedingly difficult to handle and manipulate, navigate, and operate as necessary to be effective. The cost in both time and money is considerable, and usually people with a considerable degree of expertise in such operations are required if any minesweeping of value is to be accomplished.

SUMMARY OF THE INVENTION

The present invention is, in many instances, an improvement over the known prior art devices, in that it overcomes many of the disadvantages thereof. Briefly, it consists of an artificial decoy ship-type vessel which lends itself to being configured to provide simulated ship pressure signature of considerable scope, thereby enabling it to effect the detonation or neutralization of many different types of pressure responsive marine mines. It is constructed of any desired number — the number depending on the ship signature to be simulated — of lightweight plastic center sections that are easily connected together in tandem combined with substantially streamlined fore and aft bow and stern sections of substantially ship-like configurations. Said sections are connected together in a unique manner which facilitates the assembly thereof, as well as the repair thereof in the event one or more becomes damaged by mine explosions. Any or all of said sections may contain compartments which are open at the top, within which predetermined water ballast may be disposed, so as to effect the simulation of some particular displacement ship of the type intended to be protected by minesweeping operations.

In order to make the subject mine sweeping device even more versatile, provision may also be made to achieve magnetic mine sweeping operations at the same time pressure mine sweeping operations are accomplished. This may be done very simply by attaching a coil of wire to the assembled fore, center, and aft plastic sections in such manner that it extends around the entire assembled hull simulator at some position near the submerged bottom thereof and then electrically exciting said coil by means of a programmed electric generator.

From the foregoing brief description, it may readily be seen that, compared to most prior art devices, the instant invention is simpler, more versatile, less vulnerable to mine explosion damage, and cheaper to manufacture, operate and maintain, and, accordingly, constitutes an improvement thereover.

It is, therefore, an object of this invention to provide an improved marine minesweeper.

Another object of this invention is to provide an improved method and means for detonating pressure responsive marine mines.

Still another object of this invention is to provide an improved method and means for detonating magnetic responsive marine mines.

A further object of this invention is to provide an improved method and means for simultaneously sweeping pressure responsive, acoustic responsive, and magnetic responsive marine mines along a predetermined course.

Another object of this invention is to provide an improved method of constructing a ship, a ship simulator, or a ship-like decoy.

Still another object of this invention is to provide an improved method and means for simulating the underwater pressure signatures of many different ships and other marine or submarine vehicles.

A further object of this invention is to provide a minesweeper that is less vulnerable to mine explosions than most of the prior art devices.

Another object of this invention is to provide a marine minesweeping device that is easily and economically manufactured, transported, operated, and maintained.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
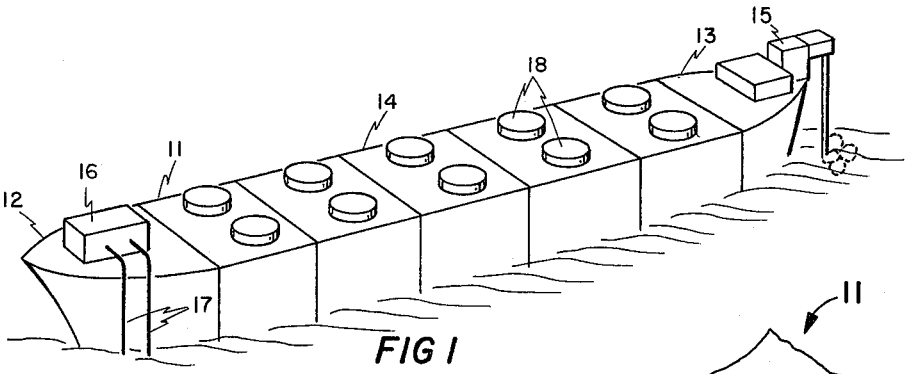
FIG. 1 is a quasi-pictorial view of the subject invention.

Referring now to FIG. 1, there is shown a water displacement type hull 11, which includes a front and bow section 12, a rear end stern section 13, and a plurality of intermediate ballast storing sections 14, the latter of which may be designed as necessary to carry whatever cargo or ballast or other materials are desired. The aforementioned bow and stern sections 12 and 13 are preferably pointedly configured in a ship-like manner, so that they will be sufficiently streamlined for the hull to be moved through sea water or the like with minimum power required therefor. Minesweeping hull 11, of course, contains a suitable propulsion and steering system, which, for example, may take the form of a simple outboard motor arrangement 15 shown as being mounted on the aforesaid stern section 13. Each of the aforementioned plurality of intermediate hull sections 14 are respectively connected to adjacent ones thereof in a unique manner which provides a secure fastening between each thereof, so as to maintain the overall hull configuration. The method and means for effecting the fastening thereof is considered to be unique and, therefore, will be disclosed in greater detail subsequently.

The use to which this particular ship hull is put would determine the type of material of which it is made; however, in this particular instance since the subject invention is primarily intended to be a marine minesweeper all of hull sections 12, 13, and 14 are preferably made of a nonmagnetic material, such as, for instance, a foam plastic material which has been molded into the desired hull shape. Mounted on hull 11 is an electrical generator 16 which, as will be more fully discussed below, provides electrical energy via electrical conductor 17 which extend around the lower portion of hull 11 in such manner as, when electrically energized, produces an electromagnetic field thereabout.

The aforementioned intermediate hull sections 14, as previously suggested, are designed to carry water ballast, cargo ballast, or any other suitable ballast materials and, hence, may be designed in whatever manner would be optimum therefor. Furthermore, such intermediate sections may contain inner compartments and covered loading and unloading hatches 18, as required.

Figure 2:
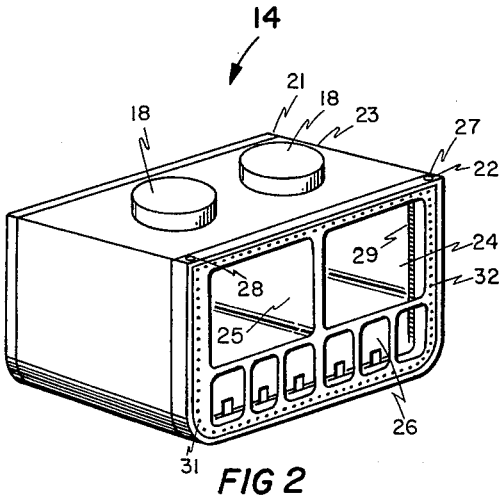
FIG. 2 is a perspective view of an intermediate hull section of the device of FIG. 1.

FIG. 2 is a representative embodiment of one of the aforesaid intermediate hull sections 14. At the opposite ends thereof are a pair of metallic plates 21 and 22, which include the attachment flanges for attaching adjacent intermediate sections together. Said attachment plates are bonded to a plastic center section 23 which, as previously indicated, is preferably of a molded foam plastic material, which contains closed air bubble cells and is very light in weight, so light in fact, that it would easily float on the surface of water even though the submerged portion thereof contained large holes, such as might be encountered in the event a marine mine is caused to be exploded in proximity thereto.

At this particular time, it would appear to be noteworthy that the size of hull 11 is a matter of design choice, with the selection of the intermediate sections 14 included therein being that number as would produce a hull length that, in turn, when properly ballasted, would stimulate whatever ship signature is believed would cause a marine mine to be exploded thereby. In other words, the design of hull 11 of the entire subject minesweeper should be such that it has a submarine pressure signature that simulates that of an actual ship or other vessel intended to be protected from marine mines.

As seen in FIG. 2, intermediate hull section 14 may be compartmented with several large compartments 24 and 25 having a plurality of small compartments 26 at the bottom thereof. In the event that hull 11 is extremely large, man holes 27 and 28 are located in the deck thereof which enable the human operators to travel down a ladder 29 or the like down to the lower compartment section. Also, the internal section of intermediate hull section 14 is so designed and made as to provide optimum strength characteristics for any given operational circumstances.

In this particular embodiment, end flange plate 22 is shown as having an annular groove 31 extending around the periphery thereof and bolt holes 32, through which fastening bolts will be mounted in the manner discussed more fully below. The intermediate hull section 14 shown in FIG. 3 likewise has a plurality of compartments adapted for storing ballast or other items necessary to the operation of the invention. In this particular arrangement, end flange 21 is shown having the lower portion thereof extending upwardly from the bottom of the hull section, so as to provide a water repelling section to within a given depth, that is dependent upon the amount of ballast used. Also, in this embodiment, an annular groove 34 is shown in the end of said flange plate 21 which is complementary with the annular groove of, say, any other intermediate hull section 14 fastened thereto.

As may be readily seen from the embodiment of intermediate section 14 of hull 11, the hull section shown is divided by a center wall 35 running vertically between the upper deck and the bottom thereof. This wall is, of course, optional, like that shown but not referenced in the section of FIG. 2 (which is also optional).

Figure 4:
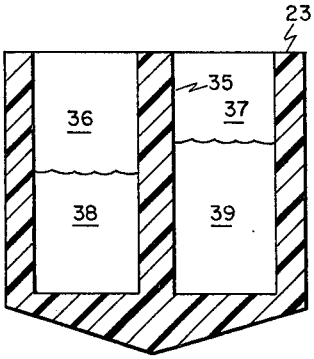
FIG. 4 is a cross-sectional view of the center portion of an intermediate hull section of the device of FIG. 1.

FIG. 4 discloses a typical cross-section taken through the foam plastic portion of one of the intermediate hull sections 14. Hence, it depicts the aforementioned center vertical wall 35, and, likewise, it shows that the hull section itself has, in this particular arrangement, a pair of cargo spaces 36 and 37 in which ballast materials 38 and 39 are respectively disposed. As a general rule, for minesweeping purposes, said ballast 38 and 39 are water, sea water, or the like. In such instance, the levels thereof within cargo spaces 36 and 37 would most likely be substantially identical; however, in the event different types of ballast materials are employed as ballast 38 and 39, the level of one could be different from the level of the other, say, because the density of one might be different from the density of the other. Obviously, by one skilled in the art having the benefit of the teachings presented herewith would readily be able to make whatever selection of ballast materials as is necessary to effect a desired minesweeping or other pressure signature below the entirety of hull 11. Moreover, it would obviously be well within the purview of the artisan to select the proper ballast and/or cargo compartments and the structures for effecting the desired configurations thereof for any given operational purposes from this disclosure. Therefore, with the exception of the unique hull section attachment means (which will be discussed subsequently), this disclosure is not intended to be limiting in any manner whatsoever but, rather, it is intended to show one preferred representative embodiment of that portion of the invention.

Figure 5:
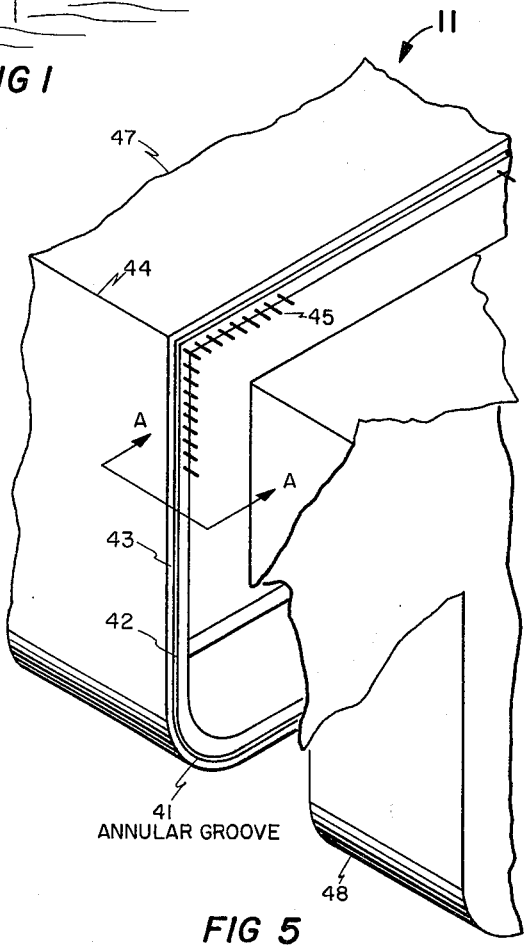
FIG. 5 is a schematic pictorial view with parts broken away of two adjacent hull sections of the device of FIG. 1.
Figure 3:
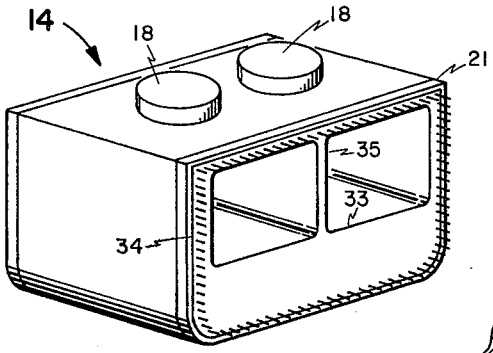
FIG. 3 is a perspective view of another intermediate hull section of the device of FIG. 1.

Referring now to FIG. 5, there is shown an exploded view, with parts broken away, of two adjacent sections of hull 11 which more readily disclose annular groove 41, which is comparable to the aforementioned annular groove 34 of the structure of FIG. 3, and the elastic sealer, such as an O-ring 42 or the like, inserted therein. Interflange plate 43 is connected in any suitable manner — as by bonding or the like — to the plastic foam section 44. Also shown is a representation of typical means for fastening the two disclosed hull sections together in such manner that they will form a watertight joint thereat. For this purpose, a plurality of bolts 45 are illustrated schematically which will extend through mating holes in the flange plate of the other intermediate hull section (not shown).

Figure 6:
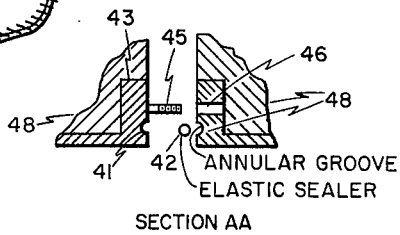
FIG. 6 is a schematic diagram of a section taken along A—A of the view of FIG. 5.

FIG. 6 is also a view of a typical fastening means that is shown as section A—A which is taken along section A—A of FIG. 5. Hence, it may be seen that bolts 45 extend through flange 43 and would extend through mating holes 46 if sections 47 and 48 are placed in abutment configuration with O-ring 42 inserted within peripheral grooves 41 and 49, respectively, of those end plates of hull sections herewith defined as being sections 47 and 48, but which may, in fact, be either of bow and stern sections 12 and 13, as well as intermediate section 14 of the hull of the subject minesweeper, as it is depicted in FIG. 1.

An exceedingly important aspect of the instant invention is the particular means that is used for fastening the hull sections together in such manner that they will be secure and waterproof. For the purpose of describing an imminently suitable device for effecting such fastening means, various and sundry reference numerals previously employed were also used in the structure of FIG. 7 for purposes of clarity. With this in mind, FIG. 7 discloses end plates or end frames 21 and 22 which are the respective end frames of say the aforementioned intermediate hull section embodiment of FIGS. 2 and 3. As a result, said frames are intended to be attached in abutment with each other in such manner that a resilient O-ring 51 of rubber, neoprene, or the like, is compressed therebetween in grooves 34 and 35 thereof for fluid sealing purposes. When so structured, of course, as depicted in FIG. 7, the lower ends of frames 21 and 22 constitute those portions thereof that are in proximity with the outer surface thereof (not shown).

A metallic cup 52 having an end flange 53 is attached as by welding 54 or any other suitable attachment means to frame 21. Disposed within said cup 52 is a resilient membrane or plug 55 which is attached to the inner surface of said cup 52 in a secure manner. Although any securing means may be employed for such purpose, the inside configuration of cup 52 may be such that it has one or more inner extensions 56 having shoulders 57 which effectively prevent the movement of membrane 55 out of cup 52 when relative forces are applied thereto. A suitable bolt 58 is molded within resilient membrane 55 so that it, too, is securely mounted therein in such manner that, due to the resilience of membrane 55, relative movement may occur therebetween without breaking apart, even though considerable forces are respectively applied thereto. A pair of holes 61 are respectively located in plates 21 and 22 in alignment with each other and in alignment with the inside diameter of the aforementioned cup 52. Disposed therein is a metallic plug 63 having an end flange 64 and a tapered end 65, the former of which is intended to be in abutment with the surface of plate 22, and the latter of which is intended to be extended through hole 61 and 62 to the extent that it is in abutment with the aforesaid resilient member 55. Bolt 58, of course, has threads 66 over which is mounted a lock washer 67, and on which is screwed a suitable complementary nut 68.

Figure 7:
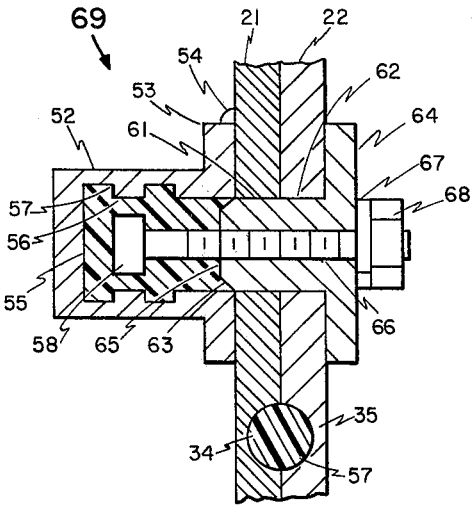
FIG. 7 is a combination elevational-cross-sectional view of one of the many fasteners incorporated in the subject invention to hold the hull sections thereof together in watertight fashion.

When assembled as shown in FIG. 7, the combination of disclosed elements thereof, in actuality, becomes a new and unique method and means 69 for fastening any two objects together in such manner that there is some flexibility therebetween but, yet, is sufficiently rigid to constitute a very secure fastening thereof. In addition, in the event grooves similar to the aforesaid grooves 34 and 35 and a resilient sealer such as the aforementioned O-ring 51 is incorporated therein as shown, a fluid tight seal is effected thereat. Accordingly, the fastening means of FIG. 7 appears to constitute a new and unique device which is highly effective in securely attaching the various and sundry hull sections of the subject minesweeper 11. Hence, it may readily be seen, that the structure of FIG. 7 is a specific and detailed structural assembly which is equivalent of the symbolically represented fastener assembly depicted in FIG. 6. Consequently, it is imminently satisfactory for the purpose of effecting the assembly of the particular sections of hull 11.

In order to be a more effective marine minesweeper — that is, in order to provide an improved method and means of simultaneously sweeping pressure responsive, acoustic responsive, and electromagnetic responsive marine mines — the hull of minesweeper 11 contains the aforementioned electrical generator 16 which supplies electrical energy to insulated electrical wires 17, the latter of which extend around the periphery of the hull at some suitable location below the water line thereof. Such arrangement is illustrated schematically in FIGS. 8 and 9, wherein the reference numerals for the various parts thereof are respectively similar to those used for like parts in the aforementioned FIG. 1.

Figure 8:
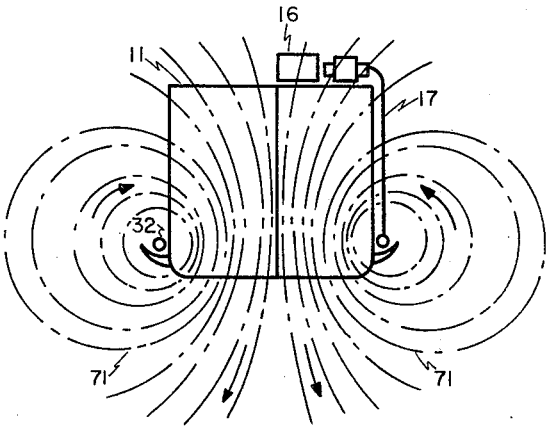
FIG. 8 is an end of the invention, particularly depicting the electromagnetic energy generated thereby.

By referring to FIG. 8, it may be seen that the aforesaid electrical motor generator 16 is mounted on the top deck of hull 11 and electrical wires 17 extend down along the side thereof and then around the bottom of the hull thereof in such manner as when electrically energized produces electromagnetic fields 71.

Figure 9:
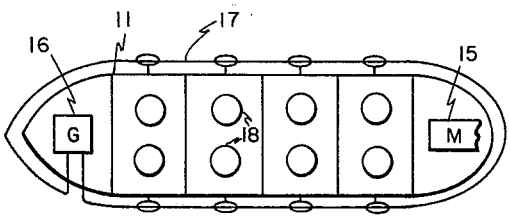
FIG. 9 is a top view of FIG. 8, showing the mounting arrangement of the electromagnetic generator system thereof.

FIG. 9, of course, is a top view of the device of FIG. 8 and, thus, illustrates how electrical wires 17 are disposed around the hull of ship 11 so that an electromagnetic field will be generated thereby when they are electrically energized. Of course, being only a schematic embodiment, the mounting means for said motor generator 16 and wires 17 may be any that are conventional and that will be suitable for such mounting purposes.

Figure 10:
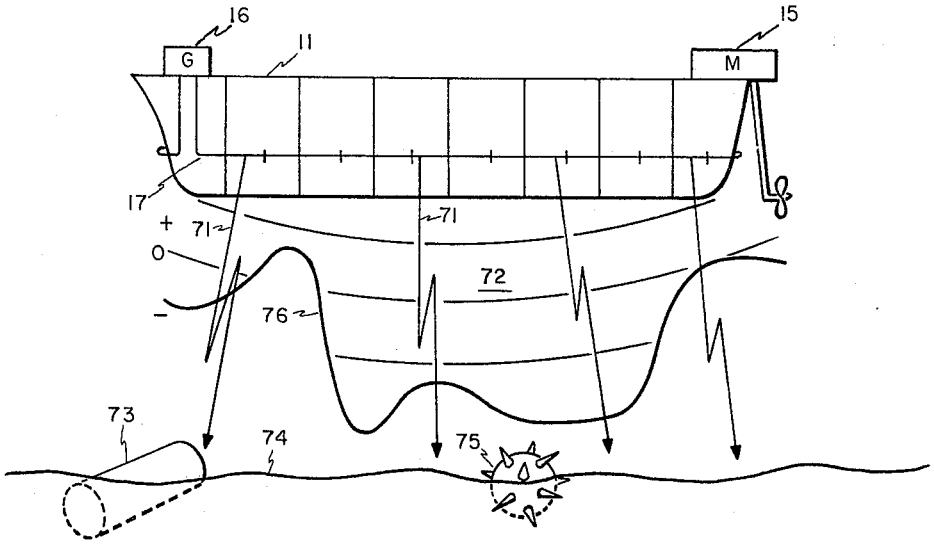
FIG. 10 is a schematic pictorial view of the subject invention and the operational effects thereof in a marine environment.

Referring now to FIG. 10 there is schematically shown a representative operational embodiment of the subject invention combined with its typical ambient environment. Also shown therein is some of the physical phenomena which are effected thereby and some of the particular devices that are, in turn, effected by said physical phenomena. Hence, minesweeper 11 which is constructed as previously disclosed in FIGS. 1 through 9 is shown as being driven through water 72 and along a course therein having say a magnetically responsive marine mine 73 laying on or partially submerged in the sea floor 74 and, perhaps, a pressure responsive marine mine 75 likewise laying on or submerged in said sea floor 74.

For reasons which will become obvious during the discussion of the operation of the subject invention, a typical underwater pressure signature 76 is graphically portrayed under minesweeper 11, so as to show how the subject invention is effective in detonating pressure responsive marine mines. Furthermore, the aforementioned electromagnetic field 71 are likewise shown symbolically in FIG. 10, in order to disclose how they are transmitted or broadcast toward magnetically responsive marine mines, so as to effect the detonation thereof.

MODE OF OPERATION

In the art of marine minesweeping, it has been determined that it is exceedingly difficult to safely sweep, neutralize, or detonate marine mines which have been deployed and activated in such bodies of water as oceans, bays, estuaries, rivers, lakes, and the like. Therefore, it becomes exceedingly important to be able to sweep enemy mines during military operations and even our own mines when said military operations cease without involving extremely hazardous duty for those concerned and without necessitating the use of complex, expensive ship or ship-like structures which could be destroyed by the very mines which they are trying to sweep. Accordingly, the more simple and economical substitute for such minesweeping ships has been implemented by means of this invention and has been done so in a manner which is considerably more effective under some circumstances.

During actual minesweeping operations, as may be seen best in FIG. 10, hull 11 is driven through water 72 by means of motor 15. Of course, as would be obvious to any one skilled in the art, hull 11 may be steered either by human or remote control, depending upon the particular situation involved. As minesweeping hull 11 is navigated along its predetermined course, due to the fact that it contains ballast 38 and ballast 39 it sinks to some particular draft depth, and, thus, generates pressure within the water below it in a manner somewhat similar to that depicted graphically by pressure signature curve 76. Of course, when the pressures thereof, the varying pressures thereof, or the relatively lack of pressures thereof, come in contact with the pressure responsive marine mine 75, due to its initial programming, it senses said pressures and interprets them as being produced by a real ship. As a result, it explodes as if it were destroying a real ship. However, due to the unique construction of hull 11, the explosion thereof does not ordinarily cause hull 11 to sink or even be damaged sufficiently to be put out of operation. This is primarily due to the fact that hull 11 is constructed of a plurality of plastic foam sections, each of which contain a large plurality of cellular trapped air bubbles within the plastic foam portions thereof. Hence, even if a hole is blown in the bottom of hull 11 within one or even several of the sections thereof, the buoyancy of hull 11 is still sufficient to enable it to float on water 72. In addition, in the event only a few of the, say, intermediate sections of hull 11 are damaged, they may be readily replaced in dry dock merely by the unfastening thereof and the substituting of new ones therefor. Due to the simplicity of this particular inventive concept, it is entirely possible that such minesweeping ship repair could be effected at or near the site of operations without too much difficulty, expense, or ancillary equipment needed therefor. Also, damaged hull sections requiring replacement can be removed and replacements therefor installed on station without the use of drydocking facilities. This can be accomplished by the proper ballasting and de-ballasting of the sections to be assembled together, with the fayings surfaces being drawn together by the securing bolts and tapered inserts. Accordingly, this increases the utility of the subject invention to a considerable extent over that which might occur with respect to the minesweepers of the prior art.

While minesweeping hull 11 is traversing its minesweeping course, it also generates and broadcasts electromagnetic energy 71 which impacts upon magnetically responsive marine mine 73 and causes it to detonate. Like the detonation of mine 75, the detonation of mine 73 may or may not damage the sections of hull 11; however, it has been found that, even though damaged, the damage thereto is usually not severe enough to put hull 11 out of commission, as far as minesweeping and cargo carrying operations are concerned.

At this time, it may also be noteworthy that although the subject invention is primarily intended as being an improved method and means of sweeping, detonating, neutralizing, and the like of marine mines, it has other utility, too. For example, due to its relative indestructability, under some circumstances it will facilitate the carrying of cargo within its ballast compartments over waters that have been mined in such manner as would otherwise destroy conventional boats or ships. Hence, it should be understood that the utility of the subject invention is not intended to be limited to minesweeping alone.

Moreover, as an adjunct to this invention, it would appear to be noteworthy that all inherent noises made thereby — such as engine noise, propeller noise, towing noise, and the like — tends to broaden the spectrum of signals which would contribute to the destruction of marine mines. Hence, when employed in conjunction with the aforementioned pressure and electromagnetic signatures, a composite minesweeping signature is effected.

In view of the foregoing, it may also be seen that the subject invention constitutes a new and unique hull assembly which constitutes an improvement over the various and sundry types of hull assemblies incorporated in various and sundry boats, ships, and other water vehicles, and especially in marine minesweepers.

Obviously, other embodiments and modifications of the subject invention will readily come to the mind of one skilled in the art having the benefit of the teachings presented in the foregoing description and the drawings. It is, therefore, to be understood that this invention is not to be limited thereto and that said modifications and embodiments are intended to be included within the scope of the appended claims.

What is claimed is:

1. A marine minesweeper, comprising in combination:

a hull, having a plurality of unitary compartmental sections disposed along the longitudinal axis thereof, with adjacent ones thereof configured for complementary fits therebetween, adapted for being floated along a watercourse suspected of being mined with marine mines, the plurality of unitary compartmental sections of said hull including a bow section, a stern section, and at least one intermediate section connected between said bow and stern sections, with said at least one intermediate section having a foam plastic hull-configured intermediate portion containing cells of air bubbles and having a plurality of compartments separated by bulkheads, a first plate securely connected to the forward end of said foam plastic hull-configured intermediate portion parallel to the transverse axis thereof, and a second plate securely connected to the rearward end of said foam plastic hull-configured intermediate portion parallel to the transverse axis thereof;

means connected between adjacent ones of said plurality of unitary compartmental hull sections for the fastening thereof together in a secure abutting manner;

means disposed between and substantially around the periphery of said adjacently fastened hull sections for effecting a watertight seal thereat; and ballast means of predetermined mass disposed in each of the plurality of unitary compartmental hull sections for effecting a predetermined draft of said hull within the aforesaid watercourse, as it is floated therealong.

2. The device of claim 1, wherein said bow and stern sections include a rearward plate and a forward plate securely connected to the rearward and forward portions thereof that are parallel to the transverse axis of said hull, respectively.

3. The device of claim 1, wherein said first and second plates each have at least one aperture extending therethrough.

4. The device of claim 1 wherein said means disposed between and substantially around the periphery of said adjacently fastened hull sections for effecting a watertight seal thereat comprises a resilient ring.

5. The device of claim 1, wherein said means disposed between and substantially around the periphery of said adjacently fastened hull sections for effecting a watertight seal thereat comprises:

a pair of grooves respectively disposed within adjacent ones of said unitary compartmental sections; and a resilient O-ring disposed between said pair of grooves.

6. The device of claim 1, wherein said ballast means of predetermined mass disposed in each of the plurality of unitary compartmental hull sections for effecting a predetermined draft of said hull within the aforesaid watercourse, as it is floated therealong, comprises water.

7. The invention of claim 1, further characterized by:

a plurality of loading hatches respectively disposed in the plurality of unitary compartmental sections of the aforesaid hull; and a like plurality of covers removably mounted over said loading hatches.

8. The invention of claim 1, further characterized by means mounted on said hull for the driving and navigating thereof along the aforesaid watercourse.

9. The invention of claim 1, further characterized by means attached to said hull for broadcasting electromagnetic energy substantially downwardly therefrom.

10. The device of claim 9, wherein said means attached to said hull for broadcasting electromagnetic energy substantially downwardly therefrom comprises:

a self-contained motor-generator for generating electrical energy; and an insulated electrical conductor mounted on and around the aforesaid hull below the water line thereof connected to said motor-generator for timely energization thereby.

* * * * *